US011663981B2

(12) United States Patent
Park et al.

(10) Patent No.: US 11,663,981 B2
(45) Date of Patent: May 30, 2023

(54) ORGANIC LIGHT EMITTING DISPLAY DEVICE FOR OUTPUTTING COMPENSATED IMAGE DATA BASED ON OPERATION CHARACTERISTICS OF SUB-PIXELS

(71) Applicant: LG Display Co., Ltd., Seoul (KR)

(72) Inventors: Sanghyun Park, Seoul (KR); Yung Choi, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/558,328

(22) Filed: Dec. 21, 2021

(65) Prior Publication Data

US 2022/0199041 A1 Jun. 23, 2022

(30) Foreign Application Priority Data

Dec. 22, 2020 (KR) ..... 10-2020-0181149

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2320/0295* (2013.01); *G09G 2320/043* (2013.01)

(58) Field of Classification Search
CPC ..... G09G 3/3291
USPC ..... 345/76
See application file for complete search history.

(56) References Cited

U.S. PATENT DOCUMENTS

2008/0252569 A1* 10/2008 Kwon ..... G09G 3/3233 345/76
2017/0004764 A1* 1/2017 Kim ..... G09G 3/3233
2018/0151124 A1* 5/2018 An ..... G09G 3/3266

FOREIGN PATENT DOCUMENTS

KR 10-2018-0025038 A 3/2018
KR 10-1887238 B1 8/2018

* cited by examiner

*Primary Examiner* — Long D Pham
(74) *Attorney, Agent, or Firm* — Birch, Stewart, Kolasch & Birch, LLP

(57) ABSTRACT

An organic light-emitting display device includes a data driver which supplies a data voltage to a data line of each sub-pixel, and senses a driving voltage of each sub-pixel through each sensing line connected to a sub-pixel, and generates sensed data based on the driving voltage of each sub-pixel. Further, the organic light-emitting display device includes a controller that generates a reference parameter for compensating for each of operation characteristics of each sub-pixel using the sensed data generated from the data driver, and compensates for image data based on the reference parameter and outputs the compensated image data. The controller controls the gate driver and the data driver so that sensed data is additionally generated, and compensates for and outputs the image data based on a compensation parameter extracted based on the additionally generated sensed data, thereby controlling execution of external compensation based on temperature and deterioration characteristics.

13 Claims, 6 Drawing Sheets

ORGANIC LIGHT EMITTING DISPLAY DEVICE FOR OUTPUTTING COMPENSATED IMAGE DATA BASED ON OPERATION CHARACTERISTICS OF SUB-PIXELS

CROSS-REFERENCE TO RELATED APPLICATION

This application claims the priority benefit under 35 U.S.C. § 119(a) of Korean Patent Application No. 10-2020-0181149 filed on Dec. 22, 2020 in the Korean Intellectual Property Office, the entire contents of which are hereby expressly incorporated by reference for all purposes into the present application.

BACKGROUND

Field

The present disclosure relates to an organic light-emitting display device, and more particularly, to an organic light-emitting display device which can perform external compensation for deterioration characteristics while excluding temporarily variable influence upon detection of the deterioration characteristics, thereby increasing detection accuracy and external compensation efficiency.

Description of the Related Art

An image display device that displays various information on a screen is a key technology in a current information communication era, and is being developed to provide a thinner, lighter, portable and high-performance device.

In particular, an organic light-emitting display device among the image display devices is advantageous in terms of power consumption due to a low operation voltage, and has a high-speed response speed, high luminous efficiency, a larger viewing angle, and excellent contrast ratio, and thus is receiving more attention as color display means.

An organic light-emitting display device renders an image using a plurality of sub-pixels arranged in a matrix form. Each of the plurality of sub-pixels includes an organic light emitting element, and a switching thin film transistor (TFT), a driving TFT, and a storage capacitor configured to independently drive the organic light emitting element.

The switching TFT of each sub-pixel is turned on in response to a scan signal from a gate line. For a turned-on period thereof, the switching TFT supplies a data voltage from a data line to a gate electrode of the driving TFT and the storage capacitor.

The driving TFT of each sub-pixel controls current flowing through the organic light emitting element based on a difference between voltages of a gate electrode and a source electrode thereof.

The organic light emitting element is connected to and disposed between the source electrode of the driving TFT and a low-potential driving voltage source. Accordingly, brightness of each sub-pixel is proportional to the current flowing through the organic light emitting element. The current flowing through the organic light emitting element is dependent on a difference between a gate voltage and a source voltage of the driving TFT, a threshold voltage Vth of the driving TFT, and mobility thereof.

In general, non-uniformity between luminance of sub-pixels in the organic light-emitting display device can be caused by differences between electrical characteristics including the threshold voltage and the mobility of the driving TFTs.

One of the causes of the differences between the electrical characteristics of the driving TFTs of the sub-pixels can be that deterioration amounts of the driving TFTs of the sub-pixels that occur during a panel operation are different from each other.

Accordingly, a method for sensing the mobilities and the threshold voltages Vth of the driving TFTs of the sub-pixels and compensating for the differences therebetween has been proposed in order to minimize the differences between the electrical characteristics of the driving TFTs of the sub-pixels.

SUMMARY OF THE DISCLOSURE

Conventionally, the compensation is made based on the differences between the mobilities and the threshold voltages of the driving TFTs of the sub-pixels as sensed in a panel manufacturing environment. Thus, additional characteristic differences can occur due to a use environment and a use period in a commercialized actual use state. Therefore, non-uniformity between luminance of the sub-pixels may be inevitable.

In order to compensate for the characteristic difference in the commercialized state, the mobility and the threshold voltage of the driving TFT of the sub-pixel should be sensed in the actual use state. However, sensing accuracy of the difference and compensation efficiency therefor can be inevitably lowered because influence on the difference can be temporarily variable based on the use environment and the operation period.

In order to address the above-mentioned problem and other issues associated with the related art, one purpose of the present disclosure is to provide an organic light-emitting display device that can measure the mobility and the threshold voltage of the driving TFT of each of the sub-pixels so that the temporarily variable influence can be excluded, and the external compensation can be made based on temperature and deterioration characteristics.

Further, another purpose of the present disclosure is to provide an organic light-emitting display device that can compensate for differences between the mobilities and threshold voltages of the driving TFTs of the sub-pixels based on temperature and deterioration characteristics in a commercialized state, and can perform the external compensation such that the compensated mobility and threshold voltage characteristics of each driving TFT are maximally similar to those as measured during a panel manufacturing.

Purposes according to the present disclosure are not limited to the above-mentioned purpose. Other purposes and advantages according to the present disclosure that are not mentioned can be understood based on following descriptions, and can be more clearly understood based on embodiments according to the present disclosure. Further, it will be easily understood that the purposes and advantages according to the present disclosure can be realized using means shown in the claims and combinations thereof.

An organic light-emitting display device according to an embodiment of the present disclosure includes a data driver which supplies a data voltage to a data line of each sub-pixel, and senses a driving voltage of each sub-pixel through each of a plurality of sensing lines connected to each of the sub-pixels, and generates sensed data based on the driving voltage of each sub-pixel.

In addition, the organic light-emitting display device can include a controller that generates a reference parameter for compensating for each of operation characteristics of each sub-pixel using the sensed data generated from the data driver, and compensates for image data based on the reference parameter and outputs the compensated image data.

The controller can control the gate driver and the data driver so that sensed data can be additionally generated, and compensate for and output the image data based on a compensation parameter extracted based on the additionally generated sensed data.

Further, a display panel of the organic light-emitting display device according to an embodiment of the present disclosure includes a sub-pixel including a switching transistor that supplies a data voltage for detection from each data line to a first node in response to a scan signal of each gate line, a storage capacitor for charging and discharging the data voltage supplied to the first node, a driving transistor for supplying a high-potential voltage to an organic light-emissive element of the second node based on a magnitude of the data voltage of the first node, and a sensing transistor that transmits a driving voltage of the driving transistor output to a second node to a sensing line in response to a sensing control signal.

The organic light-emitting display device according to the embodiment of the present disclosure can measure the mobility and the threshold voltage of the driving TFT of each of the sub-pixels so that the temporarily variable influence can be excluded, and can compensate for the differences between the operation characteristics such as the mobilities and the threshold voltages of the driving TFTs of the sub-pixels, thereby improve the detection accuracy and the external compensation efficiency.

Further, the organic light-emitting display device can compensate for differences between the mobilities and threshold voltages of the driving TFTs of the sub-pixels based on temperature and deterioration characteristics in a commercialized and actually used state, and can perform the external compensation such that the compensated mobility and threshold voltage characteristics of each driving TFT are maximally similar to those as measured during a panel manufacturing. Thus, the operation characteristic of the organic light emitting element can be further improved.

Further, in particular, for the external compensation in the commercialized state, the compensation parameter can be calculated to be as similar as possible to the reference parameter set for external compensation during the panel manufacturing, and then, the external compensation can be made based on the compensation parameter. Thus, the external compensation efficiency can be further improved.

Effects of the present disclosure are not limited to the above-mentioned effects, and other effects as not mentioned will be clearly understood by those skilled in the art from following descriptions.

BRIEF DESCRIPTION OF DRAWINGS

The present disclosure will become more fully understood from the detailed description given hereinbelow and the accompanying drawings which are given by way of illustration only, and thus are not limitative of the present disclosure.

DETAILED DESCRIPTION OF THE EMBODIMENTS

Figure 1:
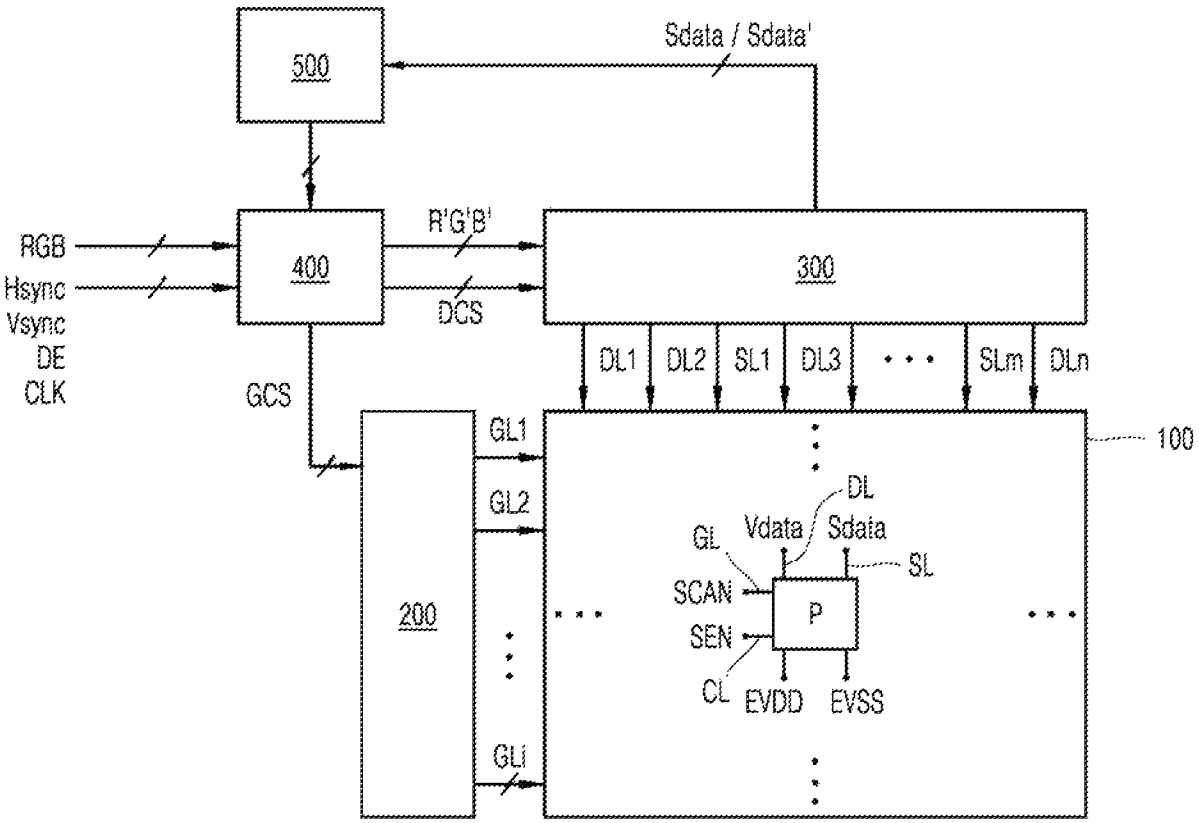
FIG. 1 is a block diagram schematically showing an organic light-emitting display device according to an embodiment of the present disclosure.

For simplicity and clarity of illustration, elements in the drawings are not necessarily drawn to scale. A shape, a size, a ratio, an angle, a number, etc. disclosed in the drawings for describing an embodiments of the present disclosure are exemplary, and the present disclosure is not limited thereto. The same reference numerals refer to the same elements herein. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure can be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as can be within the spirit and scope of the present disclosure as defined by the appended claims.

The terminology used herein is for the purpose of describing particular embodiments only and is not intended to limit the present disclosure. As used herein, the term "a" and "an" are intended to include singular usage or plural usage, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements can modify the entirety of list of elements and may not modify the individual elements of the list. When referring to "C to D", this means C inclusive to D inclusive unless otherwise specified.

It will be understood that, although the terms "first", "second", "third", and so on can be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers can be present. In addition, it will also be understood that when an element or layer is referred to as being "between" two elements or layers, it can be the only element or layer between the two elements or layers, or one or more intervening elements or layers can also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The features of the various embodiments of the present disclosure can be partially or entirely combined with each other, and can be technically associated with each other or operate with each other. An embodiments can be implemented independently of each other and can be implemented together in an association relationship.

In interpreting a numerical value in the disclosure, an error range can be inherent even when there is no separate explicit description thereof.

In a description of a signal flow relationship, for example, when a signal is transmitted from a node A to a node B, the signal can be transmitted from the node A via a node C to the node B, unless an indication that the signal is transmitted directly from the node A to the node B is specified.

Hereinafter, an organic light-emitting display device according to one or more embodiments of the present disclosure will be described in detail with reference to the accompanying drawings. All the components of each organic light-emitting display device according to all embodiments of the present disclosure are operatively coupled and configured.

FIG. 1 is a block diagram schematically showing an organic light-emitting display device according to an embodiment of the present disclosure. Moreover, FIG. 2 is an exemplary diagram showing an arrangement structure of unit pixels and sub-pixels formed in a display panel of FIG. 1.

Figure 2:
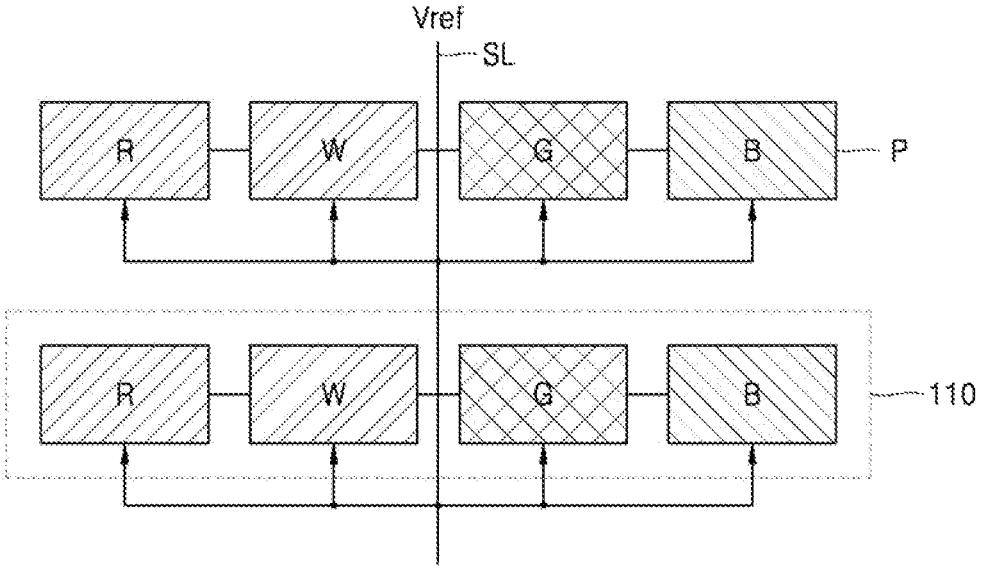
FIG. 2 is an exemplary diagram showing an arrangement structure of unit pixels and sub-pixels formed in a display panel of FIG. 1.

Referring to FIG. 1 and FIG. 2, the organic light-emitting display device includes a display panel 100, a gate driver 200, a data driver 300, a controller 400, and a storage 500.

In the display panel 100, sub-pixels P are arranged in a matrix form and are respectively disposed at intersections between a plurality of gate lines GL1 to GLi and a plurality of data lines DL1 to DLn, where i and n can be positive numbers such as positive integers. Each sub-pixel P receives a high-potential driving voltage EVDD and a low-potential driving voltage VSS, and is connected to each of the gate lines GL1 to GLi and each of the data lines DL1 to DLn.

Referring to FIG. 2, one unit pixel 110 can be composed of at least three or four sub-pixels R, G, B, and W. Hereinafter, an example in which four sub-pixels R, G, B, and W of red, green, blue, and white constitute one unit pixel 110 will be described. In this connection, FIG. 2 shows an example in which two unit pixels 110, each being composed of four sub-pixels R, G, B, W of red, green, blue, and white, are shown. A plurality of such unit pixels 110 can be used in the display device of FIG. 1.

Each of the four sub-pixel R, G, B, and W constituting each unit pixel 110 can be connected to each sensing line as each of the data lines DL1 to DLn is connected to each sub-pixel. However, in this case, a formation area of each sub-pixel P can be narrowed and thus, display efficiency can be lowered. Accordingly, as shown in FIG. 2, the four sub-pixel R, G, B, and W constituting each unit pixel 110 can be commonly connected to a single sensing line SL. When the data lines DL1 to DLn are formed in the display panel 100, a total number (m) of the sensing lines SL1 to SLm is n/4. In this connection, each of n and i is a natural number other than 0. Therefore, m is a natural number except for 0 that is ¼ of n.

Figure 3:
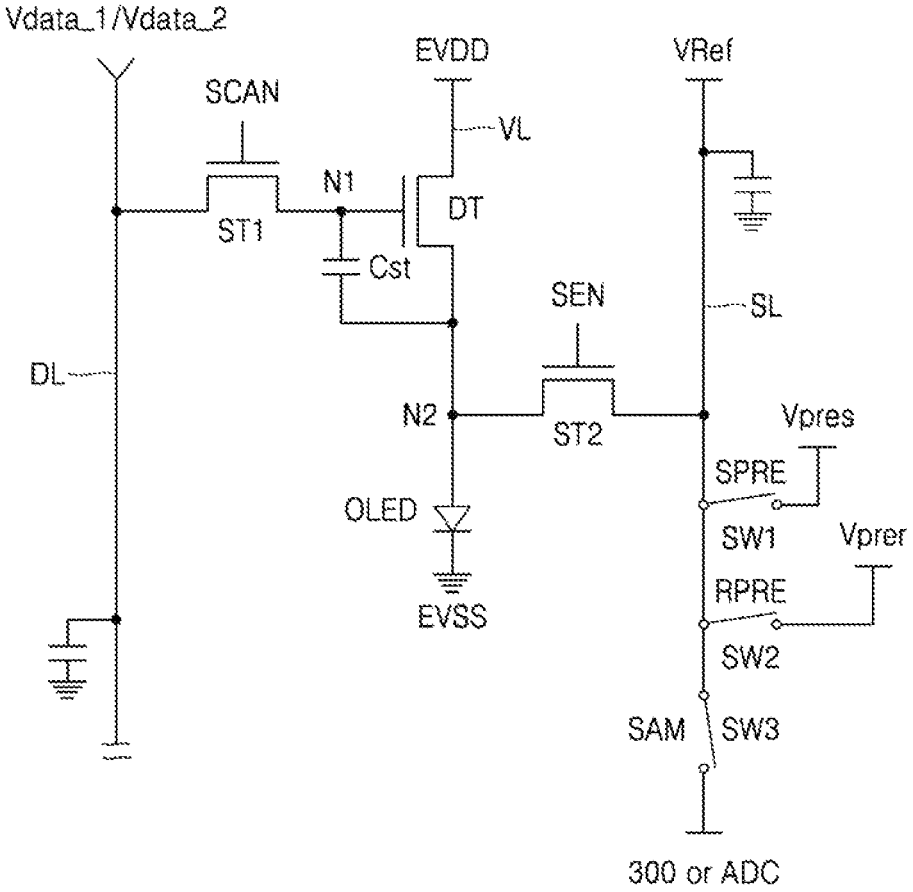
FIG. 3 is a circuit diagram specifically showing a sub-pixel structure shown in FIGS. 1 and 2.

FIG. 3 is a circuit diagram specifically showing a sub-pixel structure shown in FIGS. 1 and 2.

FIG. 3 shows a sub-pixel P structure as a 2T(Transistor) 1C(Capacitor) structure including a switching transistor ST1, a driving transistor DT, a storage capacitor Cst, and an organic light-emissive element OLED. The sub-pixel P structure can be embodied as a structure in which a transistors and a capacitor are further added other than the 2T1C structure. Hereinafter, the 2T1C structure will be described by way of example.

Referring to FIG. 3, each sub-pixel P can further include a sensing transistor ST2 which is configured for sensing mobility and a threshold voltage Vth of the driving transistor DT and is disposed between an output of the driving transistor DT and the sensing line SL.

Further, each sub-pixel P can further include an initialization switching element SW1 which applies a sensing initialization voltage Vpres to each sensing transistor ST2 for a period for detecting operation characteristics of the driving transistor DT, an enable switching element SW2 that applies a display enable voltage Vprer to each sensing transistor ST2 for an image display period of each sub-pixel P, and a line switching element SW3 connecting each sensing line SL to the data driver 300 in detecting the operation characteristics of the driving transistor DT.

A detailed configuration of the sub-pixel P according to an embodiment of the present disclosure and operation characteristics thereof are described in more detail as follows.

The switching transistor ST1 can have a gate connected to a gate line GL to which a scan signal SCAN among gate signals is supplied, a source connected to a data line DL to which a data voltage Vdata is supplied, and a drain connected to a first node N1 to which a gate of the driving transistor DT is connected. Accordingly, the switching transistor ST1 transmits the data voltage Vdata to the first node N1 for the image display period in response to the scan signal SCAN. To the contrary, for the period for detecting the operation characteristics of the driving transistor DT, for example, the mobility and the threshold voltage thereof, the switching transistor ST1 can supply a first or second data voltage Vata_1 or Vata_2 for detection from the data driver 300 to the first node N1.

The driving transistor DT has a gate connected to the first node N1, a source connected to a first power line VL to which the high-potential voltage EVDD is supplied, and a drain connected to a second node N2 electrically connected to the organic light-emissive element OLED. Accordingly, for the image display period, the driving transistor DT is activated based on a magnitude of the data voltage Vdata of the storage capacitor Cst and the first node N1. Moreover, for the period for detecting the operation characteristics of the driving transistor DT, the driving transistor DT is activated based on the first or second data voltage Vata_1 or Vata_2.

The organic light-emissive element OLED has an anode connected to the second node N2 as the drain (output) of the driving transistor DT, and a cathode connected to a second power line to which the low-potential voltage EVSS is supplied.

The sensing transistor ST2 has a gate connected to a sensing control signal input line CL to which a sensing control signal SEM among the gate signals is supplied, a source connected to the second node N2 as the drain (output) of the driving transistor DT, and a drain connected to the sensing line SL. Accordingly, the sensing transistor ST2 transmits a driving voltage output to the drain (for example, the second node N2) of the driving transistor DT to the sensing line SL in response to the sensing control signal SEM input for the period for detecting the operation characteristics of the driving transistor DT.

As shown in FIGS. 2 and 3, the four sub-pixels R, G, B, W can be connected to each of the sensing lines SL1 to SLm. Thus, each switching structure for applying the sensing initialization voltage Vpres or the display enable voltage Vprer to each sub-pixel P can be additionally included.

Specifically, the initialization switching element SW1 applies the sensing initialization voltage Vpres to the sensing line SL and the sensing transistor ST2 in response to an initialization control signal SPRE. The sensing initialization voltage Vpres is input from the gate driver 200 thereto for an initialization period for detecting the operation characteristics of the driving transistor DT in each of the sub-pixels P in a corresponding line.

The enable switching element SW2 is turned on such that the display enable voltage Vprer is applied to the sensing line SL and the sensing transistor ST2 in response to an enable control signal PPRE. The enable control signal PPRE is input from the gate driver 200 or the like thereto for an operation characteristic non-detection period for which the sub-pixels P in the corresponding line display an image.

The line switching element SW3 connects or disconnects each of the sensing lines SL1 to SLm to or from the data driver 300 or a converter ADC of the data driver 300 in response to a sampling signal SAM input from the gate driver 200 or the like. The sampling signal SAM can be supplied thereto to disconnect each of the sensing lines SL1 to SLm therefrom for the image display period of each sub-pixel P, and can be input thereto to connect each of the sensing lines SL1 to SLm thereto for a driving voltage sensing period of each sub-pixel P.

The sub-pixel P as described above can operate as follows for the period for sensing the mobility of the driving transistor DT and the threshold voltage Vth thereof.

First, when the scan signal SCAN is supplied to each sub-pixel through each gate line GL, the switching transistor ST1 is turned on in response to the scan signal SCAN. At this time, a first data voltage Vdata_1 for detection who's a magnitude is predefined so as to sense the operation characteristics of the driving transistor DT is supplied to the data line DL.

Accordingly, when the first data voltage Vdata_1 for detection is supplied to the first node N1 through the turned-on switching transistor ST1, the driving transistor DT is activated based on a magnitude of the first data voltage Vdata_1 for detection. At this time, the sensing control signal SEN is supplied to the gate of the sensing transistor ST2, such that the sensing transistor ST2 is turned on.

Subsequently, when the line switching element SW3 is turned on based on the sampling signal SAM, the driving voltage of the driving transistor DT is transmitted to the data driver 300 through the sensing transistor ST2 and the sensing line SL. In this connection, a magnitude of the driving voltage can fluctuate or vary in real time based on the deterioration characteristics of the driving transistor DT for a period for which each driving transistor DT is activated. Therefore, a voltage between the gate and the source of the driving transistor DT can be maintained at a higher level than the threshold voltage of the driving transistor DT for a predefined period, and then a driving voltage sensing path can be formed through the sensing transistor ST2, the sensing line SL and the line switching element SW3.

As described above, after the voltage between the gate and the source of the driving transistor DT is maintained at a higher level than the threshold voltage of the driving transistor DT for a predefined period, or after the voltage between the gate and the source of the driving transistor DT and the threshold voltage of the driving transistor DT are equal to each other, the driving voltage of each driving transistor DT can be sensed. Thus, influence based on mobility variation of each driving transistor DT can be eliminated. In other words, although the mobility of the each driving transistor DT can continue to vary for the period for which each driving transistor DT is activated, the voltage between the gate and the source of the driving transistor DT is variable up to and maintained at the threshold voltage. Thus, in stabilizing the driving voltage of each driving transistor DT, the influence based on the mobility variation can be eliminated and excluded.

A voltage detection process for detecting the operation characteristics of the driving transistor DT in each sub-pixel P is performed only when a compensation parameter for compensating for differences between mobilities and threshold voltages of the driving transistors DT of the sub-pixels P is generated. In one example, in a manufacturing process of an organic light-emitting display device, a reference mobility difference and a reference threshold voltage difference can be detected first, and then a reference parameter for compensating for each of the reference mobility difference and the threshold voltage difference can be set and stored.

During the actual use period after the organic light-emitting display device is commercialized, the mobility and the threshold voltage of the driving transistor DT of each sub-pixel P can be sensed in response to the user's control command or pre-programmed control command (for example, in a power off operation). Thus, an additional compensation parameter can be created based on the sensed mobility and the threshold voltage and then can be applied to the external compensation.

For example, in order to additionally generate or update the compensation parameter when power is turned off, the gate driver 200 sequentially generates a scan signal SCAN in response to a gate control signal GCS. Moreover, the scan signal SCAN is sequentially transmitted to the plurality of gate lines GL1 to GLi. Thus, the scan signal SCAN is supplied to each sub-pixel P.

Further, the gate driver 200 separately supplies the sensing control signal SEN to the sensing transistor ST2 of each sub-pixel P in response to the gate control signal GCS from the controller 400.

On the other hand, the data driver 300 additionally supplies the second data voltage Vdata 2 for detection to each of the sub-pixels P through the plurality of data lines DL1 to DLn in response to the data control signal DCS. Moreover, the data driver 300 senses the driving voltage of each sub-pixel P input through each of the sensing lines SL1 to SLm for a specific blank period, and converts the sensed driving voltage into digital sensed data Sdata' and stores the digital sensed data Sdata' into the storage 500.

Next, the controller 400 receives the sensed data Sdata' additionally detected and generated by the data driver 300 from the storage 500, compares the additionally detected sensed data S data' with each other and then creates and stores the compensation parameter based on the comparing result. Moreover, when image data RGB from an external system is input the controller 400, the controller 400 adds the additionally generated compensation parameter value to the image data RGB or multiplies the image data RGB by the additionally generated compensation parameter value and generates and outputs compensated image data R'G'B'.

The controller 400 can create the additional compensation parameters to be as similar as possible to the reference parameter set at the time of manufacturing the organic light-emitting display device. To this end, the controller 400 can compare the sensed data Sdata' as additionally detected and generated with the sensed data Sdata as detected during the product manufacturing process, and generate and use the compensation parameter so that a comparison difference therebetween can be minimized. A compensation parameter generation method will be described in more detail later with reference to the accompanying drawings.

Figure 4:
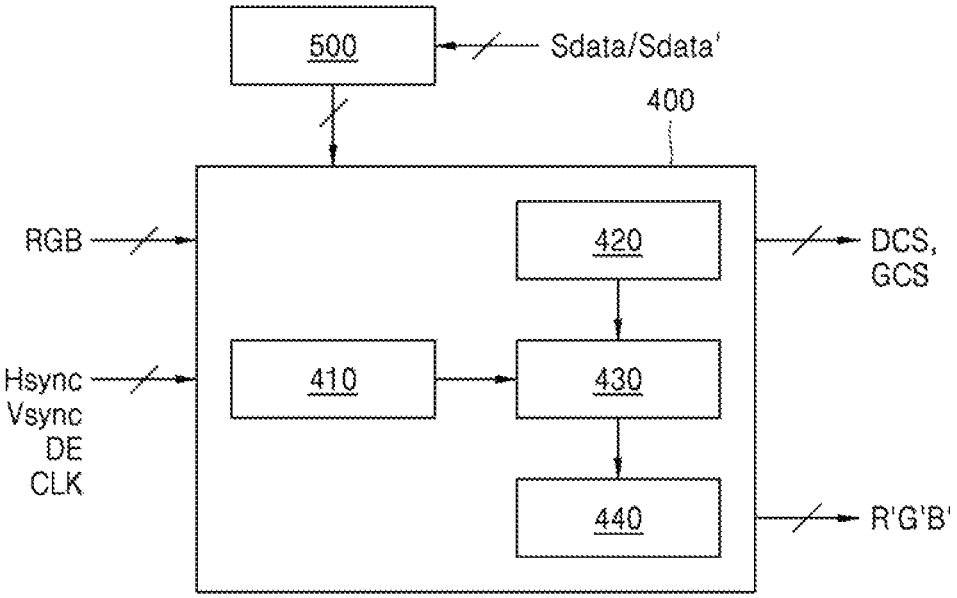
FIG. 4 is a block diagram showing a controller shown in FIG. 1 in detail.

FIG. 4 is a block diagram showing the controller shown in FIG. 1 in detail.

Referring to FIG. 4, the controller 400 can be configured to be in combination with various processors, for example, a microprocessor, a mobile processor, an application processor, and the like, based on types of a device on which the controller 400 is mounted. The controller 400 includes an external compensator 410, a control signal generator 420, a data alignment module 430, and a data output module 440.

Specifically, the external compensator 410 compares and analyzes the sensed data Sdata and Sdata' detected using the data driver 300, and creates the reference parameter and the compensation parameter for compensating for the differences between the mobilities and threshold voltages of the driving transistors DT of the sub-pixels P, based on the computing and analysis results. For reference, the compensation parameter for compensating for the differences between the mobilities and threshold voltages of the driving transistors DT can be calculated using an equation or a method presented in Korean Patent No. 10-1887238 (2018 Aug. 3) owned by the present applicant. This patent document is herein incorporated by reference.

The external compensator 410 receives the image data RGB from an external system, etc. and compensates for the image data of each sub-pixel P by applying the compensation value based on the reference parameter or the compensation value based on the compensation parameter to the input image data RGB.

In particular, the external compensator 410 can generate and use the compensation parameter so that the difference between the sensed data Sdata detected during the product manufacturing process and the additionally detected sensed data Sdata' can be minimized. In this case, the compensation parameter can be set by sequentially updating the compensation parameter so that the additionally detected sensed data Sdata' can be detected in a maximally similar state to the sensed data Sdata detected during the product manufacturing process. Therefore, the external compensator 410 performs the external compensation step by step so that the difference based on the temperature and deterioration characteristics occurring in the commercialized state can be minimized, and the mobility and the threshold voltage of each driving TFT can be closer as possible to the mobility and the threshold voltage of each driving TFT measured during the panel manufacturing process.

The control signal generator 420 generates the gate and data control signals GCS and DCS for image display for the image display period and transmits the same to the gate and data drivers 200 and 300. Moreover, according to the control command after the commercialization of the device, the control signal generator 420 generates the gate and data control signals GCS and DCS for sensing the mobility and the threshold voltage of driving transistor DT of each sub-pixel P for the image non-display period and transmits the same to the gate and data drivers 200 and 300.

The data alignment module 430 aligns the compensated image data R'G'B' generated by applying the reference parameter or the compensation parameter to the input image data RGB, according to characteristics such as a resolution and an operation frequency of the display panel 100.

The data output module 440 outputs the compensated image data R'G'B' aligned based on the resolution of the display panel 100 to the data driver 300, on at least one horizontal line basis depending on the operation frequency of display panel 100.

Figure 5:
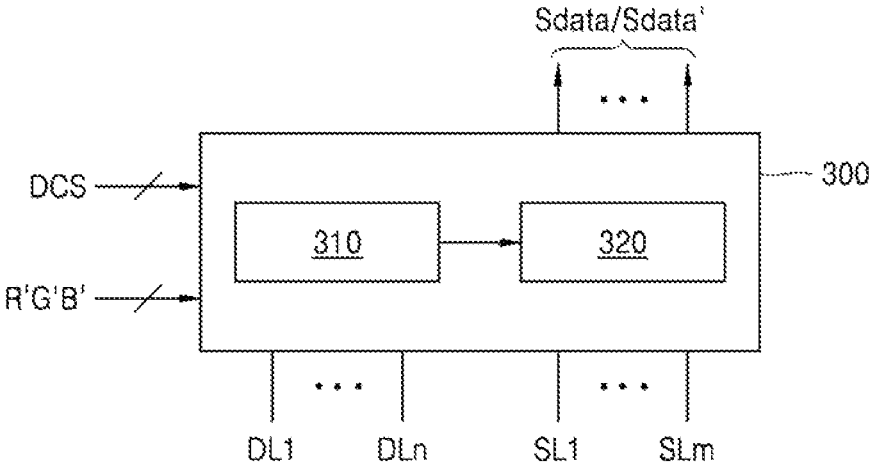
FIG. 5 is a block diagram showing a data driver shown in FIG. 1 in detail.

FIG. 5 is a block diagram showing the data driver shown in FIG. 1 in detail.

Referring to FIG. 5, the data driver 300 includes a data voltage output module 310 and a driving voltage sensing module 320.

The data voltage output module 310 converts the compensated image data R'G'B' from the controller 400 into analog data voltage Vdata and sequentially supplies the converted analog data voltage Vdata to each of the data lines DL1 to DLn.

The driving voltage sensing module 320 senses the driving voltage of each sub-pixel P input through each of the sensing lines SL1 to SLm for the image non-display period, converts the sensed driving voltage into digital sensed data Sdata, and transmits the digital sensed data Sdata to the storage 500.

Figure 6:
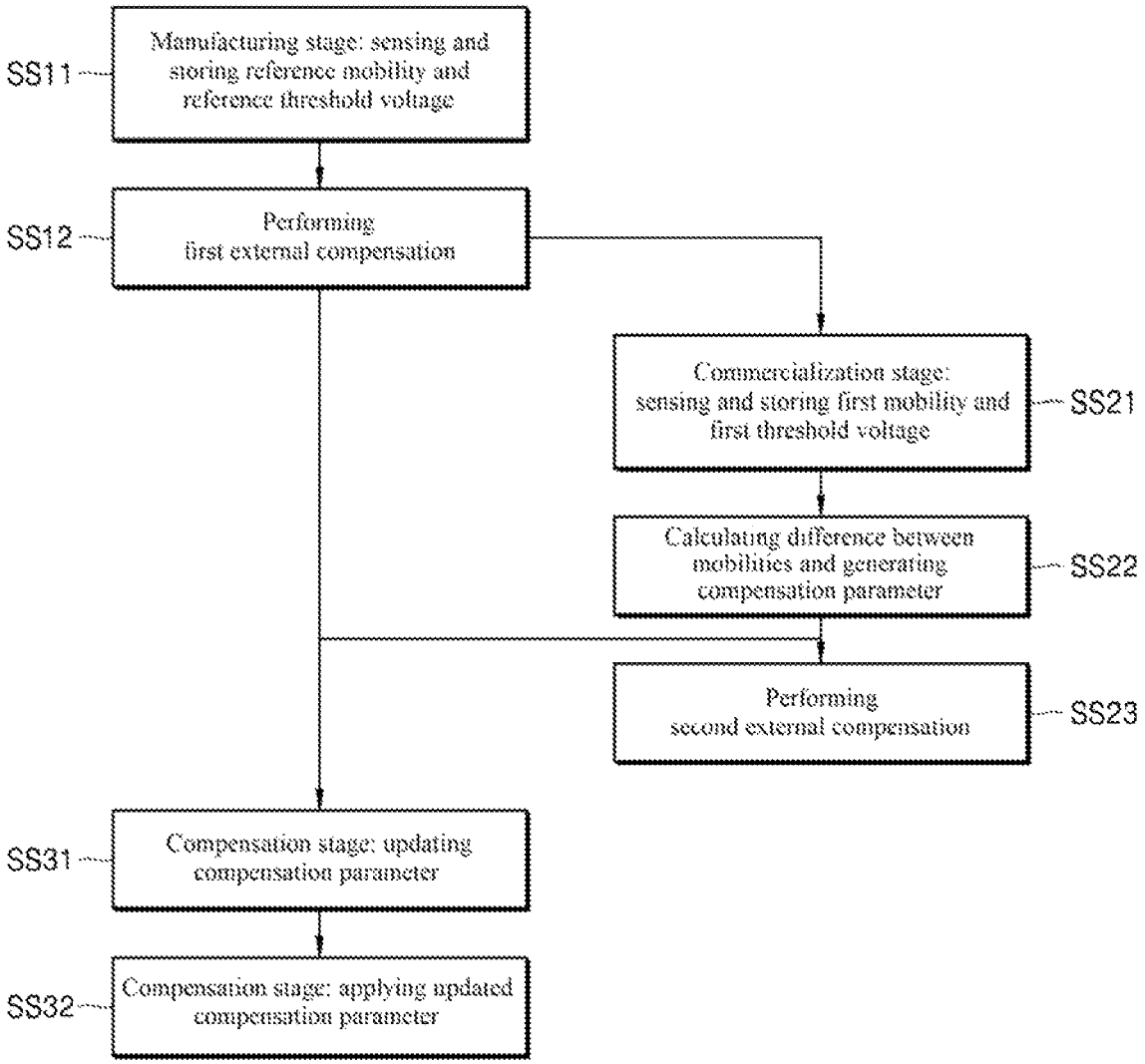
FIG. 6 is a flowchart for illustrating a method for performing external compensation of an organic light-emitting display device according to an embodiment of the present disclosure.

FIG. 6 is a flowchart for illustrating a method for performing external compensation of an organic light-emitting display device according to an embodiment of the present disclosure.

Detailed descriptions of the compensation parameter generation and external compensation process by the controller 400 is as follows.

Referring to FIG. 6, in a process of manufacturing and inspecting the organic light-emitting display device, the reference parameter for compensating for each of the differences between the mobilities and the threshold voltages Vth of the driving transistors DT of the sub-pixels P can be generated using a probe unit or the like.

In this connection, an inspection device such as the probe unit can supply the scan signal SCAN to the switching transistor ST1 of each sub-pixel P, and supply the first data voltage Vdata_1 for detection to each data line DL, and thus sense the driving voltage of each driving transistor DT through the sensing transistor ST2 and the sensing line SL. Moreover, the controller 400 can generate the reference parameter based on the comparison and analysis result of the sensed data Sdata (SS11).

Then, the organic light-emitting display device can compensate for the image data RGB input from the external system using a compensation value based on the reference parameter after commercialization of the device, and can display the image corresponding to the compensated image data on the display panel 100 (SS12).

When the organic light-emitting display device is in a commercialized and actual use state, the mobility and the threshold voltage of the driving transistor DT of each sub-pixel P can be re-sensed based on the user's control command or the pre-programmed control command. Then, the compensation parameter can be calculated based on the re-sensed mobility and threshold voltage and then can be applied to the external compensation.

To this end, the controller 400 generates the gate and data control signals GCS and DCS for the image non-display period and respectively transmits the gate and data control signals GCS and DCS to the gate and data drivers 200 and 300. Thus, the mobility and the threshold voltage of the driving transistor DT of each sub-pixel P can be sensed (SS21). Moreover, the controller 400 can compare and analyze the sensed data Sdata' that are additionally detected and generated using the data driver 300 and generate and store the compensation parameter based on the comparing and analyzing result (SS22).

Then, depending on the settings, the image data RGB is input from the external system, and the image data of each sub-pixel P can be compensated for by adding the additionally generated compensation parameter value to the image data of each sub-pixel P or multiplying the image data of each sub-pixel P by the additionally generated compensation parameter value (SS23).

In one example, the controller 400 can update and generate the compensation parameter so that the difference between the sensed data Sdata detected during the product manufacturing process and the sensed data Sdata' additionally detected during the actual use of the device can be minimized. In this case, the controller 400 can generate and set the compensation parameter by updating the compensation parameter step by step so that the additionally detected sensed data Sdata' is more similar, step by step, to the sensed data Sdata detected during the product manufacturing process (SS31).

Further, the external compensator 410 included in the controller 400 can compensate for a difference based on the temperature and deterioration characteristics that occur in the commercialized and actually used state of the device, and can perform the external compensation while updating the compensation parameter step by step such that the mobility and threshold voltage of each driving TFT in the commercialized and actually used state of the device can be respectively as similar as possible, step by step, to the mobility and threshold voltage of each driving TFT as measured during the panel manufacturing process (SS32).

Figure 7:
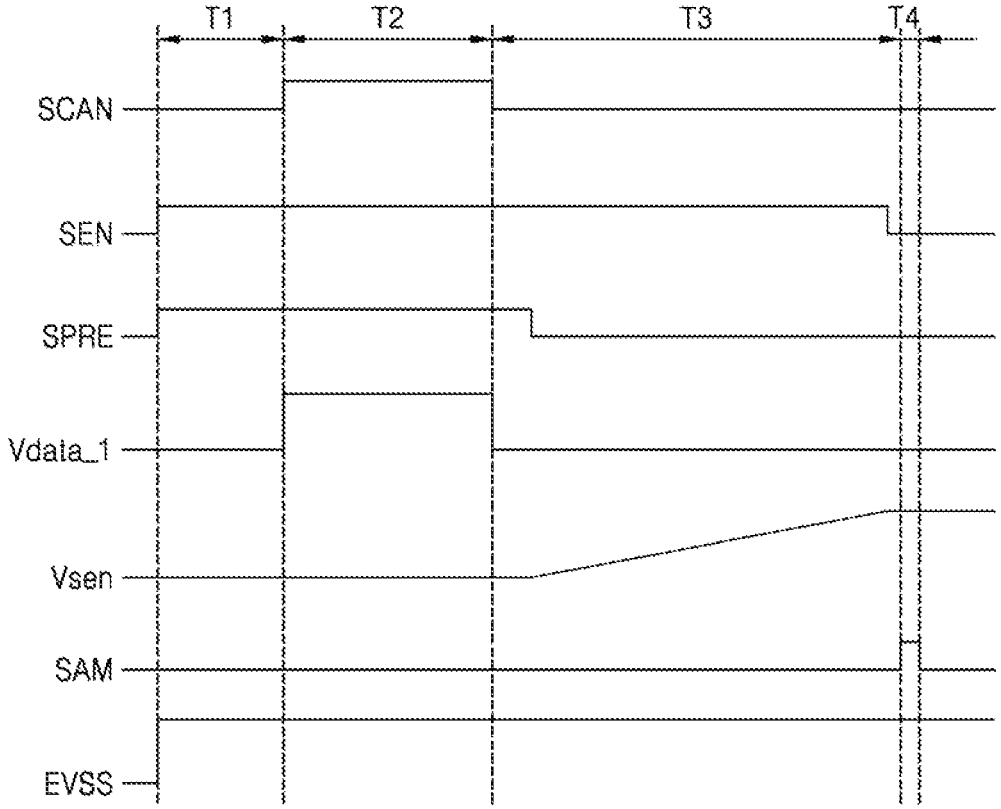
FIG. 7 is a timing diagram for illustrating a mobility and threshold voltage measurement process in a product manufacturing step according to an embodiment of the present disclosure.

FIG. 7 is a timing diagram for illustrating a mobility and threshold voltage measurement process in a product manufacturing process according to an embodiment of the present disclosure.

Referring to FIG. 7, in a process of manufacturing and commercializing an organic light-emitting display device, the reference parameter for compensation for a difference between operation characteristics of the sub-pixels P can be set first in a device inspection process using an auto probe unit, etc.

An operation period of each sub-pixel for sensing the mobility and the threshold voltage Vth of each driving transistor DT of each sub-pixel P can be divided into an initialization period T1, a programming period T2, a driving voltage maintaining period T3, and a sensing period T4.

Referring to FIG. 3 and FIG. 7, for the initialization period T1 of the operation period of each sub-pixel P for sensing the mobility and the threshold voltage Vth of the driving transistor DT, the switching transistor ST1 and the driving transistor DT are maintained at a turned off state, and the sensing initialization voltage Vpres is applied to the sensing transistor ST2 and the sensing line SL.

For the programming period T2, the scan signal SCAN is supplied to the switching transistor ST1 through the gate line GL, and the first data voltage Vdata_1 for detection which is predefined for the turned-on period of the switching transistor ST1 is supplied to the data line DL.

For the driving voltage maintaining period T3, the sensing control signal SEN is supplied to the sensing transistor ST2 to turn on the sensing transistor ST2. Thus, the driving voltage (the output voltage of the driving transistor DT) of the driving transistor DT activated in a corresponding manner to a magnitude of the first data voltage Vdata_1 for detection is detected through the sensing line SL.

For the sensing period T4, the line switching element SW3 is turned on in response to the sampling signal SAM. Thus, the driving voltage of the driving transistor DT is transmitted to the data driver 300 through the sensing transistor ST2 and the sensing line SL. Moreover, when the line switching element SW3 is turned off, the display enable voltage Vprer is applied to the sensing transistor ST2 and the sensing line SL to reset the sensing transistor ST2 and the sensing line SL.

In one example, in the process of detecting the mobility and the threshold voltage of the driving transistor DT of each sub-pixel P to set the reference parameter, the low-potential voltage of the low-potential voltage source EVSS connected to the cathode of the organic light-emissive element OLED can be raised up to a voltage level higher than 0V, such that at least 0V voltage can be applied to the cathode of the organic light-emissive element OLED. When the low-potential voltage applied to the cathode of organic light-emissive element OLED is raised up, the mobility and threshold voltage detection timing and accuracy of the driving transistor DT can be improved.

Figure 8:
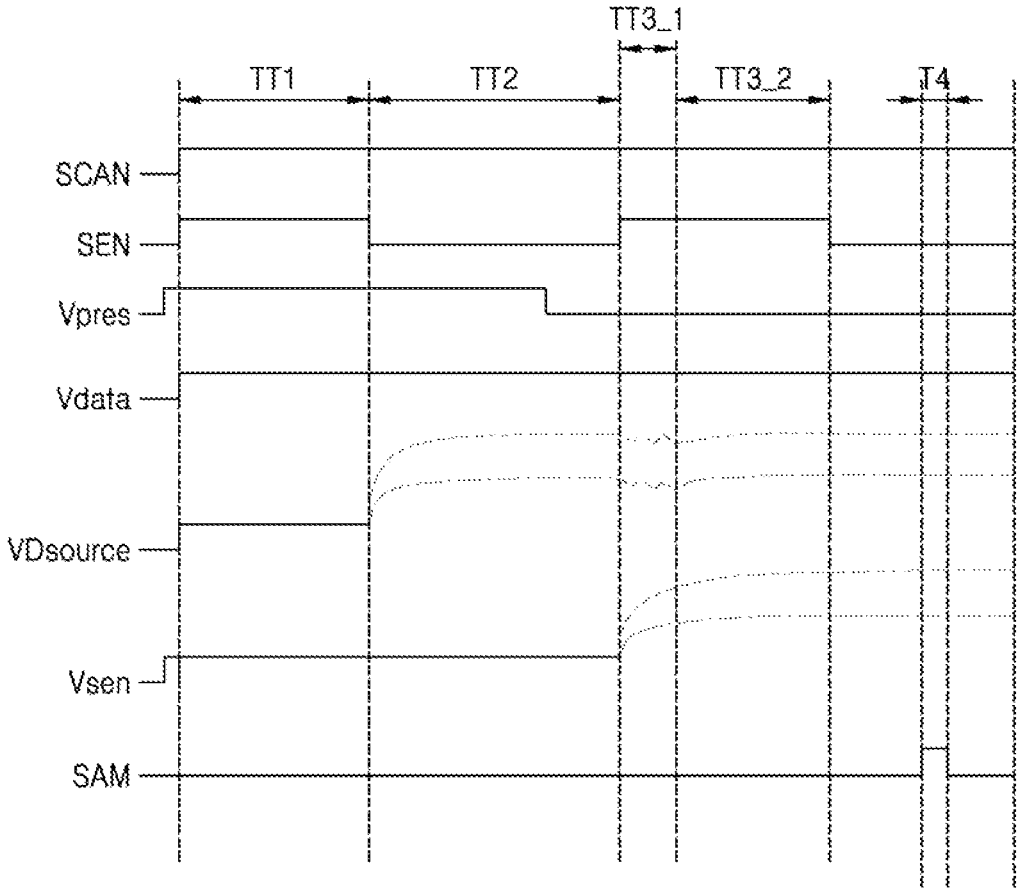
FIG. 8 is a timing diagram for illustrating a mobility and threshold voltage measurement process in an actual use stage according to an embodiment of the present disclosure.

FIG. 8 is a timing diagram for illustrating the mobility and threshold voltage measurement process in an actual use stage of the device according to an embodiment of the present disclosure.

In order to compensate for the difference between the operation characteristics of the sub-pixels P when the organic light-emitting display device is actually used in the commercialized state, the reference parameter must be updated, for example, the compensation parameter different from the reference parameter must be additionally created. For this purpose, the mobility and the threshold voltage of each driving transistor DT must be sensed repeatedly in the actual use state, so that the compensation parameter can be repeatedly updated and applied to the external compensation.

Referring to FIG. 8, an operation period for sensing the mobility and the threshold voltage of the driving transistor DT of each sub-pixel P in the actual use state can be divided into an enable period TT1, a deterioration maintaining period TT2, a driving voltage variation maintaining period TT3_1, a driving voltage output control period TT3_2, and a driving voltage sensing period T4.

For the enable period TT1, the scan signal SCAN can be supplied to the switching transistor ST1, and at the same time, the sensing control signal SEN can be supplied to the sensing transistor ST2 to turn on both of the switching transistor ST1 and the sensing transistor ST2.

In this connection, the sensing initialization voltage Vpres can be applied to the sensing transistor ST2 and the sensing line SL. The predefined second data voltage Vdata 2 for detection is applied to the storage capacitor Cst through the switching transistor ST1.

For the deterioration maintaining period TT2, the switching transistor ST1 is maintained at a turned-on state and the sensing transistor ST2 is turned off. Accordingly, the driving transistor DT is activated based on the charged voltage of the storage capacitor Cst so that the driving transistor DT is maintained in a deteriorated state.

When the sensing transistor ST2 is turned off for the deterioration maintaining period TT2, the driving transistor DT is activated based on the charged voltage of the storage capacitor Cst, thereby increasing the gate-source voltage of the driving transistor DT. At this time, the gate-source voltage of the driving transistor DT rises up in response to the deterioration amount of the organic light-emissive element OLED. Accordingly, the present method can detect the driving voltage of the driving transistor DT in a more accurate manner based on the deterioration amount of the organic light-emissive element OLED as well as the driving transistor DT.

For the driving voltage variation period TT3_1, the sensing control signal SEN can be supplied to the sensing transistor ST2 to turn on the sensing transistor ST2. Since the sensing transistor ST2 is turned on, a driving current of the driving transistor DT flows toward the sensing transistor ST2, such that the magnitude of the driving voltage of the driving transistor DT fluctuates or varies in real time.

Although the magnitude of the driving voltage of the driving transistor DT fluctuates or varies in real time based on the deterioration characteristics of the driving transistor DT, the gate-source voltage of the driving transistor DT is maintained at a level higher than that of the threshold voltage of the driving transistor DT, based on the charged voltage of the storage capacitor Cst. Accordingly, the driving voltage of the driving transistor DT decreases very slowly or is maintained at a stable state, based on the charged voltage of the storage capacitor Cst.

For the driving voltage output control period TT3_2, the gate-source voltage of the driving transistor DT is maintained at a level higher than that of the threshold voltage of the driving transistor DT. Accordingly, the driving voltage of the driving transistor DT is applied to the sensing transistor ST2 for a period for which the driving transistor DT outputs the driving voltage.

The mobility of each driving transistor DT can be continuously varied for a period for which each driving transistor DT is activated. However, even when the mobility of each driving transistor DT is varied, the gate-source voltage of the driving transistor DT is variable only up to the threshold voltage and is maintained at the threshold voltage. Thus, the influence based on the mobility variation of each driving transistor DT can be eliminated and excluded.

For the driving voltage sensing period TT4, the present scheme can first turn off the sensing transistor ST2, and then can supply the sampling signal SAM to the line switching element SW3 to electrically connect each of the sensing lines SL1 to SLm to the data driver 300. Accordingly, the driving voltage of each driving transistor DT applied to each of the sensing lines SL1 to SLm is transmitted to the data driver 300.

In this way, the organic light-emitting display device according to the present disclosure excludes the temporarily variable influence when measuring the mobility and the threshold voltage of the driving transistor DT, and compensates for the difference between the operations characteristics of the driving transistors DT based on the measurement, thereby improving the external compensation efficiency and accuracy.

Further, the controller 400 repeats this sensing process to update and generate the compensation parameter so that the difference between the sensed data S data detected during the product manufacturing process and the sensed data Sdata' as detected additionally can be minimized. In this connection, the compensation parameter can be corrected so that the additionally detected sensed data Sdata' is more similar to the sensed data Sdata detected during the product manufacturing process.

Furthermore, the organic light-emitting display device can compensate for differences between the mobilities and threshold voltages of the driving TFTs of the sub-pixels based on temperature and deterioration characteristics in a commercialized and actually used state, and can perform the external compensation such that the compensated mobility and threshold voltage characteristics of each driving TFT are maximally similar to those as measured during a panel manufacturing. Thus, the operation characteristic of the organic light emitting element can be further improved. Further, in particular, for the external compensation in the commercialized state, the compensation parameter is calculated to be as similar as possible to the reference parameter set for external compensation during the panel manufacturing, and then, the external compensation can be made based on the compensation parameter. Thus, the external compensation efficiency can be further improved.

Although the embodiments of the present disclosure have been described in more detail with reference to the accompanying drawings, the present disclosure is not necessarily limited to these embodiments. The present disclosure can be implemented in various modified manners within the scope not departing from the technical idea of the present disclosure. Accordingly, the embodiments disclosed in the present disclosure are not intended to limit the technical idea of the present disclosure, but to describe the present disclosure. The scope of the technical idea of the present disclosure is not limited by the embodiments. Therefore, it should be understood that the embodiments as described above are illustrative and non-limiting in all respects. The scope of protection of the present disclosure should be interpreted by the claims, and all technical ideas within the scope of the present disclosure should be interpreted as being included in the scope of the present disclosure.

What is claimed is:

1. An organic light-emitting display device comprising:

a display panel including a plurality of sub-pixels respectively disposed at intersections between a plurality of gate lines and a plurality of data lines;

a gate driver configured to supply a scan signal to each of the plurality of gate lines;

a data driver configured to supply a data voltage to each of the plurality of data lines, wherein the data driver is configured to detect a driving voltage of each sub-pixel through each of a plurality of sensing lines connected to a sub-pixel, and to generate sensed data based on the detected driving voltage of each sub-pixel; and a controller configured to generate a reference parameter for compensating for a difference between operation characteristics of sub-pixels based on the sensed data, to compensate for image data using the reference parameter, and to output the compensated image data, wherein the controller is further configured to:

control the gate driver and the data driver so that additional sensed data is generated;

calculate a compensation parameter based on the additional sensed data;

compensate for the image data using the calculated compensation parameter and output the compensated image data; and correct the compensation parameter so that a difference between the sensed data detected for generating the reference parameter and the additional sensed data is minimized.

2. The organic light-emitting display device of claim 1, wherein the controller is further configured to:

generate a gate control signal and a data control signal to allow the data driver to sense a driving voltage of a driving transistor of each sub-pixel, and respectively transmit the gate control signal and the data control signal to the gate driver and the data driver for an image non-display period; and compare and analyze the additional sensed data of each sub-pixel generated using the data driver, and generate the compensation parameter based on the comparing and analyzing result so that each of differences between mobilities and threshold voltages of driving transistors of the sub-pixels is minimized.

3. The organic light-emitting display device of claim 2, wherein the controller is further configured to update the compensation parameter step by step so that the additional sensed data is step by step closer to the sensed data detected for generating the reference parameter.

4. The organic light-emitting display device of claim 1, wherein the controller includes:

an external compensator configured to:

compare and analyze the sensed data detected for generating the reference parameter, and generate the reference parameter for compensation for each of the differences between the mobilities and the threshold voltages of the driving transistors of the sub-pixels, based on the comparing and analyzing result; and compare and analyze the additional sensed data, generate the compensation parameter based on the comparing and analyzing result, and compensate for the image data using the reference parameter or the compensation parameter; and a control signal generator configured to:

generate gate control signal and data control signal for image display, and respectively transmit the gate control signal and data control signal to the gate driver and data driver, for an image display period; and generate gate control signal and data control signal for sensing the mobility and the threshold voltage of each driving transistor of each sub-pixel, and respectively transmit the gate control signal and data control signal to the gate driver and data driver, for an image non-display period.

5. The organic light-emitting display device of claim 1, wherein each sub-pixel includes:

a switching transistor configured to supply a data voltage from each data line to a first node in response to the scan signal from each of the gate lines;

a storage capacitor configured to charge therein and discharge therefrom a data voltage for detection supplied to the first node;

a driving transistor configured to supply a high-potential voltage to an organic light-emissive element connected to a second node, based on a magnitude of the data voltage for detection supplied to the first node; and a sensing transistor configured to transmit the driving voltage of the driving transistor output to the second node to the sensing line, in response to a sensing control signal from the gate driver.

6. The organic light-emitting display device of claim 5, wherein the controller is further configured to generate the gate control signal and data control signal so that a period for which the mobility and the threshold voltage of each driving transistor of each sub-pixel are sensed is divided into:

an initialization period for which a sensing initialization voltage is applied to the sensing transistor and the sensing line;

a programming period for which the data voltage is transmitted to the data line for a turned-on period of the switching transistor;

a driving voltage maintaining period for which the sensing transistor is turned on so that the driving voltage of the driving transistor is transmitted to the sensing line; and a reset period for which the driving voltage of the driving transistor is transmitted to the data driver through the sensing transistor and the sensing line.

7. The organic light-emitting display device of claim 5, wherein the controller is further configured to generate the gate control signal and data control signal so that a period for which the mobility and the threshold voltage of each driving transistor of each sub-pixel are sensed is divided into:

an enable period for which the switching transistor and the sensing transistor are turned on, and a sensing initialization voltage is applied to the sensing transistor and the sensing line, so that the storage capacitor charges therein the data voltage;

a deterioration maintaining period for which the switching transistor is maintained at a turned-on state, and the sensing transistor is turned off so that the driving transistor is activated;

a driving voltage variation period for which the sensing transistor is turned on, and a magnitude of the driving voltage of the driving transistor is maintained at a constant level;

a driving voltage output control period for which the driving voltage of the driving transistor is supplied to the sensing line while a gate-source voltage of the driving transistor is higher than the threshold voltage of the driving transistor; and a driving voltage sensing period for which the driving voltage of the driving transistor is transmitted to the data driver through each sensing line.

8. An organic light-emitting display device comprising:

a display panel including a plurality of sub-pixels respectively disposed at intersections between a plurality of gate lines and a plurality of data lines;

a gate diver and a data driver configured to drive the plurality of sub-pixels; and a controller configured to control the gate diver and the data driver, wherein each of the plurality of sub-pixels includes:

a switching transistor configured to supply a data voltage for detection from each data line to a first node in response to a scan signal of each gate line;

a storage capacitor configured to charge therein and discharge therefrom the data voltage supplied to the first node;

a driving transistor configured to supply a high-potential voltage to an organic light-emissive element connected to a second node, based on a magnitude of the data voltage supplied to the first node; and a sensing transistor configured to transmit a driving voltage of the driving transistor output to the second node to each of sensing lines, in response to a sensing control signal, wherein the controller is configured to generate a reference parameter for compensating for a difference between operation characteristics of sub-pixels based on the sensed data, to compensate for image data using the reference parameter, and to output the compensated image data, wherein the controller is further configured to:

control the gate driver and the data driver so that additional sensed data is generated;

calculate a compensation parameter based on the additional sensed data;

compensate for the image data using the calculated compensation parameter and output the compensated image data; and correct the compensation parameter so that a difference between the sensed data detected for generating the reference parameter and the additional sensed data is minimized.

9. The organic light-emitting display device of claim 8, wherein each sub-pixel further includes:

an initialization switching element configured to apply a sensing initialization voltage to the sensing line and the sensing transistor in response to an initialization control signal from the gate driver;

an enable switching element configured to apply a display enable voltage to the sensing line and the sensing transistor in response to an enable control signal from the gate driver; and a line switching element configured to connect or disconnect each sensing line to or from the data driver in response to a sampling signal from the gate driver.

10. The organic light-emitting display device of claim 9, wherein the controller is further configured to generate gate control signal and data control signal so that a period for which mobility and a threshold voltage of each driving transistor of each sub-pixel are sensed is divided into:

an enable period for which the switching transistor and the sensing transistor are turned on, and a sensing initialization voltage is applied to the sensing transistor and the sensing line, so that the storage capacitor charges therein the data voltage;

a deterioration maintaining period for which the switching transistor is maintained at a turned-on state, and the sensing transistor is turned off so that the driving transistor is activated;

a driving voltage variation period for which the sensing transistor is turned on, and a magnitude of the driving voltage of the driving transistor is maintained at a constant level;

a driving voltage output control period for which the driving voltage of the driving transistor is supplied to the sensing line while a gate-source voltage of the driving transistor is higher than the threshold voltage of the driving transistor; and a driving voltage sensing period for which the sampling signal is supplied to the line switching element, so that the driving voltage of the driving transistor is transmitted to the data driver through each sensing line.

11. The organic light-emitting display device of claim 10, wherein the data driver is configured to sense a driving voltage of each sub-pixel through each of the sensing lines to generate sensed data based on the driving voltage of each sub-pixel, and wherein the controller is configured to generate a reference parameter for compensating for a difference between operation characteristics of sub-pixels, based on the sensed data, to compensate for image data using the reference parameter, and to output the compensated image data.

12. The organic light-emitting display device of claim 11, wherein the controller is further configured to:

control the gate driver and the data driver so that additional sensed data is generated;

calculate a compensation parameter based on the additional sensed data; and compensate for the image data using the calculated compensation parameter and output the compensated image data.

13. The organic light-emitting display device of claim 12, wherein the controller is further configured to update the compensation parameter step by step so that the additional sensed data is step by step closer to the sensed data detected for generating the reference parameter.

* * * * *